US010486884B2

(12) United States Patent
Pentzer

(10) Patent No.: US 10,486,884 B2
(45) Date of Patent: Nov. 26, 2019

(54) VACUUM PACKAGING APPARATUS

(71) Applicant: JLS Automation, York, PA (US)

(72) Inventor: Jon Pentzer, Hampstead, MD (US)

(73) Assignee: JLS Automation, York, PA (US)

( * ) Notice: Subject to any disclaimer, the term of this patent is extended or adjusted under 35 U.S.C. 154(b) by 0 days.

(21) Appl. No.: 15/827,682

(22) Filed: Nov. 30, 2017

(65) Prior Publication Data

US 2019/0161265 A1 May 30, 2019

(51) Int. Cl.

| | |
|---|---|
| ***B65D 81/20*** | (2006.01) |
| ***B65D 75/58*** | (2006.01) |
| ***B65B 5/04*** | (2006.01) |
| ***B65B 43/18*** | (2006.01) |
| ***B65B 5/10*** | (2006.01) |
| *B65B 31/02* | (2006.01) |
| *B65B 11/52* | (2006.01) |

(52) U.S. Cl.

CPC ..... *B65D 81/2023* (2013.01); *B65B 5/04* (2013.01); *B65B 5/105* (2013.01); *B65B 43/18* (2013.01); *B65D 75/5855* (2013.01); *B65B 11/52* (2013.01); *B65B 31/028* (2013.01)

(58) Field of Classification Search

CPC ..... B65D 81/2023

USPC ..... 294/183, 185, 189

See application file for complete search history.

(56) References Cited

U.S. PATENT DOCUMENTS

| | | | | |
|---|---|---|---|---|
| 4,674,785 | A * | 6/1987 | Riesenberg | B25B 11/005 294/186 |
| 5,020,842 | A * | 6/1991 | Miwa | A01H 4/001 294/183 |
| 5,207,553 | A * | 5/1993 | Konagai | B25J 15/0616 294/65 |
| 6,802,688 | B1 * | 10/2004 | Andersen | B65G 47/90 294/188 |
| 6,979,032 | B2 * | 12/2005 | Damhuis | B25J 15/0052 294/185 |
| 8,402,723 | B2 | 3/2013 | Granili | |
| 9,896,289 | B2 * | 2/2018 | Sawatzky | B65H 5/08 |
| 10,065,328 | B2 * | 9/2018 | Takeuchi | F16K 31/126 |
| 2004/0051323 | A1 * | 3/2004 | Stohr | B25J 9/1015 294/65 |
| 2006/0131905 | A1 * | 6/2006 | Mazzucchelli | B65G 47/91 294/188 |
| 2013/0129464 | A1 * | 5/2013 | Regan | B25J 15/0691 414/800 |

* cited by examiner

*Primary Examiner* — Paul T Chin

(74) *Attorney, Agent, or Firm* — Barley Snyder

(57) ABSTRACT

A vacuum packaging apparatus for securing a plurality of vacuum skin packaging (VSP) products is provided and includes a receiving plate, a plurality of cavity walls, and a plurality of vacuum channels. The plurality of cavity walls extending downward from a planar bottom surface of the receiving plate and provide a plurality of cavities there within. The plurality of cavity walls includes an upper cavity wall encircling an upper cavity of the plurality of cavities, and a lower cavity wall encircling a lower cavity that is positioned adjacent to the upper cavity and recessed with respect to the upper cavity walls. The plurality of vacuum channels extend through the receiving plate and into the plurality of cavities.

19 Claims, 9 Drawing Sheets

FIG. 8

VACUUM PACKAGING APPARATUS

FIELD OF THE INVENTION

The invention relates to a packing apparatus and, more particularly, to a vacuum packaging apparatus for vacuum skin products.

BACKGROUND

Product packaging for food provides protection, tampering resistance, and product information of processed food before it is delivered to the consumer.

Vacuum skin packaging (VSP) has become preferred as it removes almost all of the residual oxygen from the package, which is a benefit to the retailer and consumer. Known vacuum skin packing techniques typically include a tray that is then sealed with a plastic film as in U.S. Pat. No. 8,402,723.

While some food packaging is generally symmetrical and regularly shaped, during vacuum skin packaging the plastic film that is formed over the food can provide an asymmetrical- or irregularly-shaped packaging surface. This makes it difficult for known packing devices to move the VSP food product after sealing. Each package requires transfer from the VSP stations into shipping containers (i.e., boxes) for transport, warehousing, logistics, sale, display, and delivery.

Robotic packing systems are often used to transfer the VSP product from processing stations to subsequent packing and handling stages. Known robotic packing systems generally include a packing device that is connected to and controlled by a articulating arm that uses an optical system to provide information for positioning of the gripping device. The packing device may include a vacuum system to facilitate movement of the food product during packing. Known systems lack improved features to grasp, lift, hold, and pack VSP food products in containers for transport, warehousing, logistics, sale, display, and delivery.

Therefore, there is a need for a packing apparatus, such as a vacuum packaging apparatus and system, to grasp, lift, hold, and then pack VSP products that are contained in irregularly-shaped and/or deformable packaging.

SUMMARY

A vacuum packaging apparatus for securing a plurality of vacuum skin packaging (VSP) products is provided and includes a receiving plate, a plurality of cavity walls, and a plurality of vacuum channels. The plurality of cavity walls extending downward from a planar bottom surface of the receiving plate and provide a plurality of cavities there within. The plurality of cavity walls includes an upper cavity wall encircling an upper cavity of the plurality of cavities, and a lower cavity wall encircling a lower cavity that is positioned adjacent to the upper cavity and recessed with respect to the upper cavity walls. The plurality of vacuum channels extend through the receiving plate and into the plurality of cavities.

BRIEF DESCRIPTION OF THE DRAWINGS

The invention will be explained in greater detail in the following with reference to embodiments, referring to the appended drawings, in which.

DETAILED DESCRIPTION OF THE EMBODIMENT(S)

Embodiments of the invention will now be described in greater detail with reference to the drawings.

Figure 1:
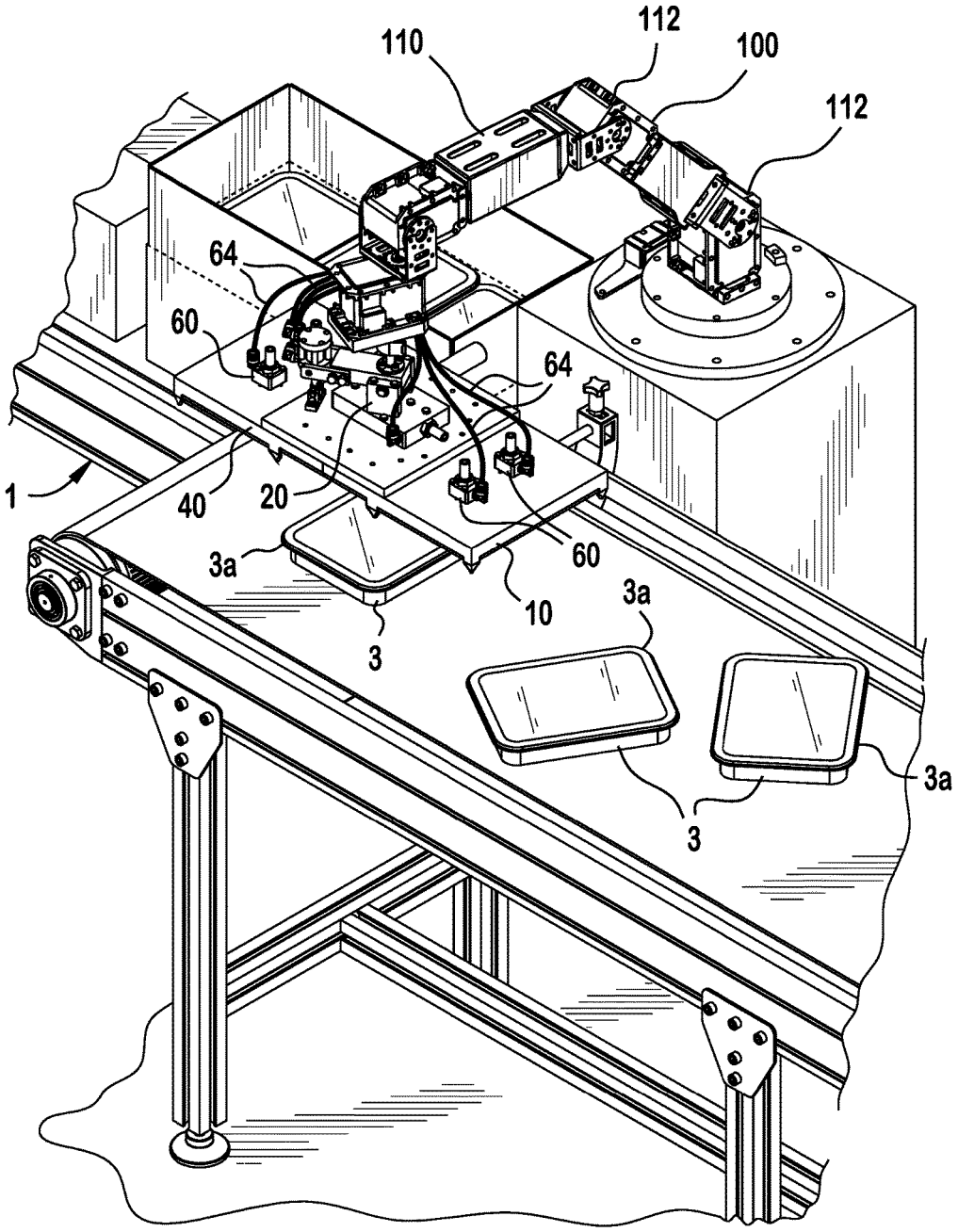
FIG. 1 is a perspective view of a robotic packing system equipped with a vacuum packaging apparatus according to the invention.

Referring first to FIG. 1, a robotic vacuum packing system 1 is shown and generally includes a vacuum packaging apparatus 10 according to an embodiment of the invention, an articulating arm assembly 100, and an optical positioning system (not shown).

Now, with reference to FIGS. 2-8, a vacuum packaging apparatus 10 according to an embodiment of the invention will be described.

Figure 2:
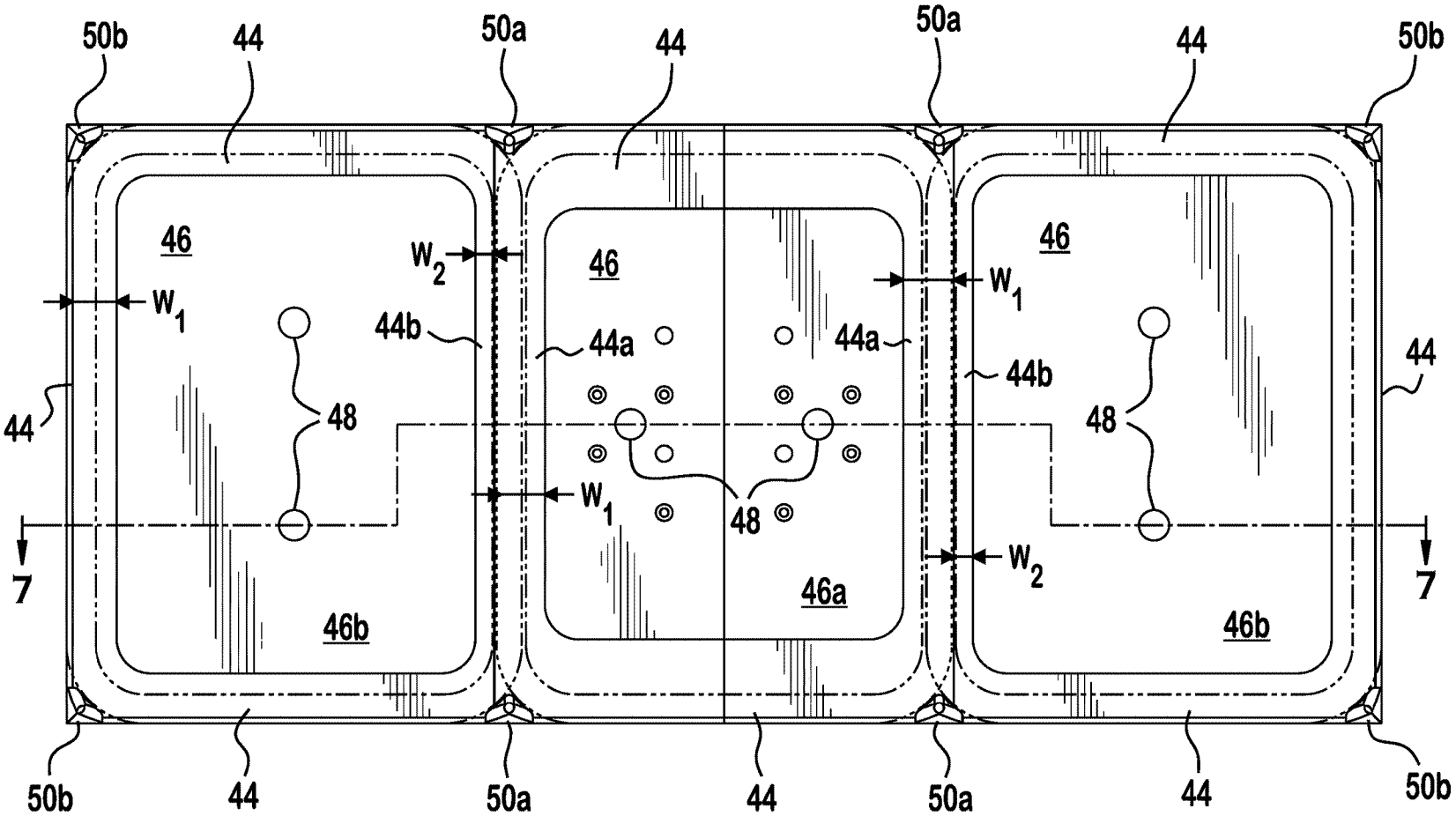
FIG. 2 is a front, top perspective view of the vacuum packaging apparatus according to the invention, showing a plurality of VSP products secured to a bottom thereof.
Figure 3:
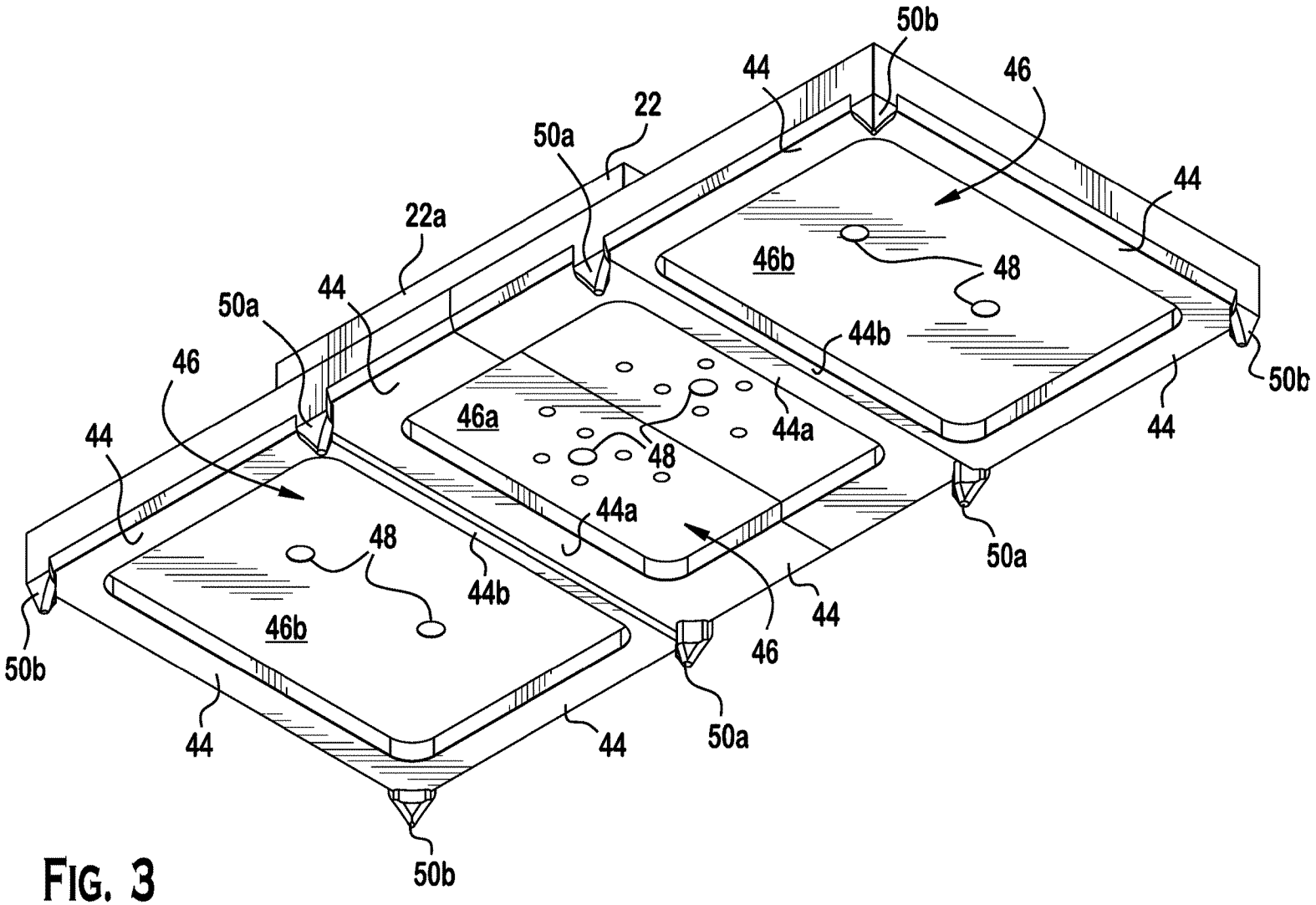
FIG. 3 is a front, bottom perspective view of the vacuum packaging apparatus of FIG. 2, shown without the three VSP products.

As shown in FIGS. 2 and 3, the vacuum packaging apparatus 10 generally includes the following major components: a pivot assembly 20, a positioning assembly 40, and a vacuum assembly 60.

In an embodiment of the invention, the pivot assembly 20 generally includes a mounting plate 22, a lever 24 and a pivot mechanism 26.

In the shown embodiment, the mounting plate 22 includes a body 22*a* a pair of vertical supports 22*b* that is a rectangular flat sheet member that supports the positioning assembly 40 and a portion of the vacuum assembly 60. The mounting plate 22 further include a pair of vertical supports 22*b* extending upward from and positioned perpendicular with respect to a planar surface of the body 22*a*. The mounting plate 22 is secured to the positioning assembly 40 using known connection methods, including fasteners, adhesives, or mechanical welds.

The lever 24 is an elongated member that is pivotally mounted to the articulating arm assembly 100 and the mounting plate 22 using the vertical supports 22*b* and a support pin 25 that runs through the lever 24. In the shown embodiment, the lever 24 pivots about the support pin 25 and with respect to position of the articulating arm assembly 100 and the mounting plate 22.

The pivot mechanism 26 is a switch that activates on and off based on pivot position with respect to the mounting plate 22. The pivot mechanism 26 rigidly connects to the lever 24 using horizontal supports 27 that extend from an end thereof. The pivot mechanism 26 further connects to the mounting plate 22 using an articulating connector 28. As a result, the pivot mechanism 26 pivots with respect to the articulating arm assembly 100 and the mounting plate 22. When the pivot mechanism 26 activates, the lever 24 pivots and tilts the positioning assembly 40 for transport and packaging of the VSP product 3.

As shown in FIGS. 2 and 3, the positioning assembly 40 generally includes a receiving plate 42, a plurality of cavity walls 44, and a plurality of positioning nodes 50.

The receiving plate 42 is generally rectangular shaped member in the shown embodiment. The cavity walls 44 extend downward from a bottom surface thereof and provide a plurality of cavities 46. In the shown embodiment, three rectangular shaped cavity walls 44 are provided and correspond with three cavities 46—one lower cavity 46*a* and a pair of upper cavities 46*b* that are flanked to the side of the lower cavity 46*a*. It is conceivable for the invention to have more or less cavities 46 than as shown, and would be designed based on the size and number of VSP products 3 that require transport.

As shown, the cavity walls 44 of lower cavity 46*a* (lower cavity walls 44*a*) are recessed with respect to the cavity walls 44 of the upper cavities 46*b* (upper cavity walls 44*b*). Each cavity wall 44 has a planar top surface that runs parallel throughout. Further, the lower cavity walls 44*a* run parallel with the upper cavity walls 44*b*. The top planar surface of the lower cavity wall 44*a* is separated from the top planar surface of the upper cavity wall 44*b* by a height H that corresponds to a thickness T of the tray deck 3*a*. Therefore, height H should be about equal to the thickness T of the tray deck 3*a*. In an exemplary embodiment of the invention, the thickness T of the tray deck 3*a* is approximately 3/16 in.

As shown, outer sections of the upper cavity walls 44*b* and the lower cavity walls 44*a* have the same width $W_1$. However, the inner sections of the upper cavity walls 44*b* are thinner and have a smaller width $W_2$ than the outer section of upper cavity walls 44*b* and the lower cavity walls 44*a*. Since the lower cavity walls 44*a* are recessed from the upper cavity walls 44*b* by a height H (corresponding to the thickness of a tray deck 3*a* the VSP product 3), adjacent tray decks 3*a* overlap when position on the upper cavity walls 44*b* and the lower cavity walls 44*a*.

Figure 4:
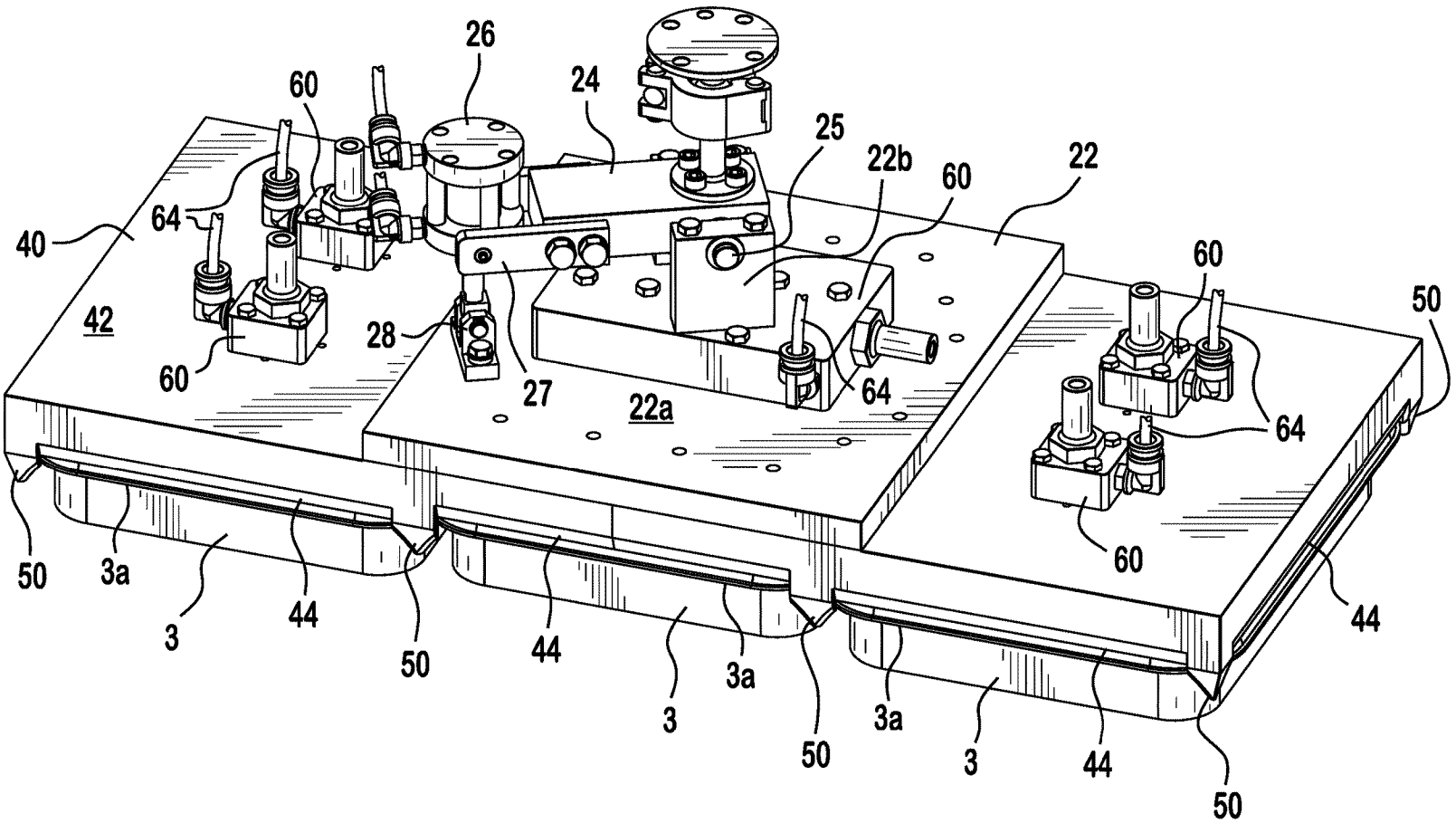
FIG. 4 is bottom view of a vacuum packaging apparatus according to the invention showing a plurality of VSP products secured and arranged in an overlapping adjacent manner.
Figure 5:
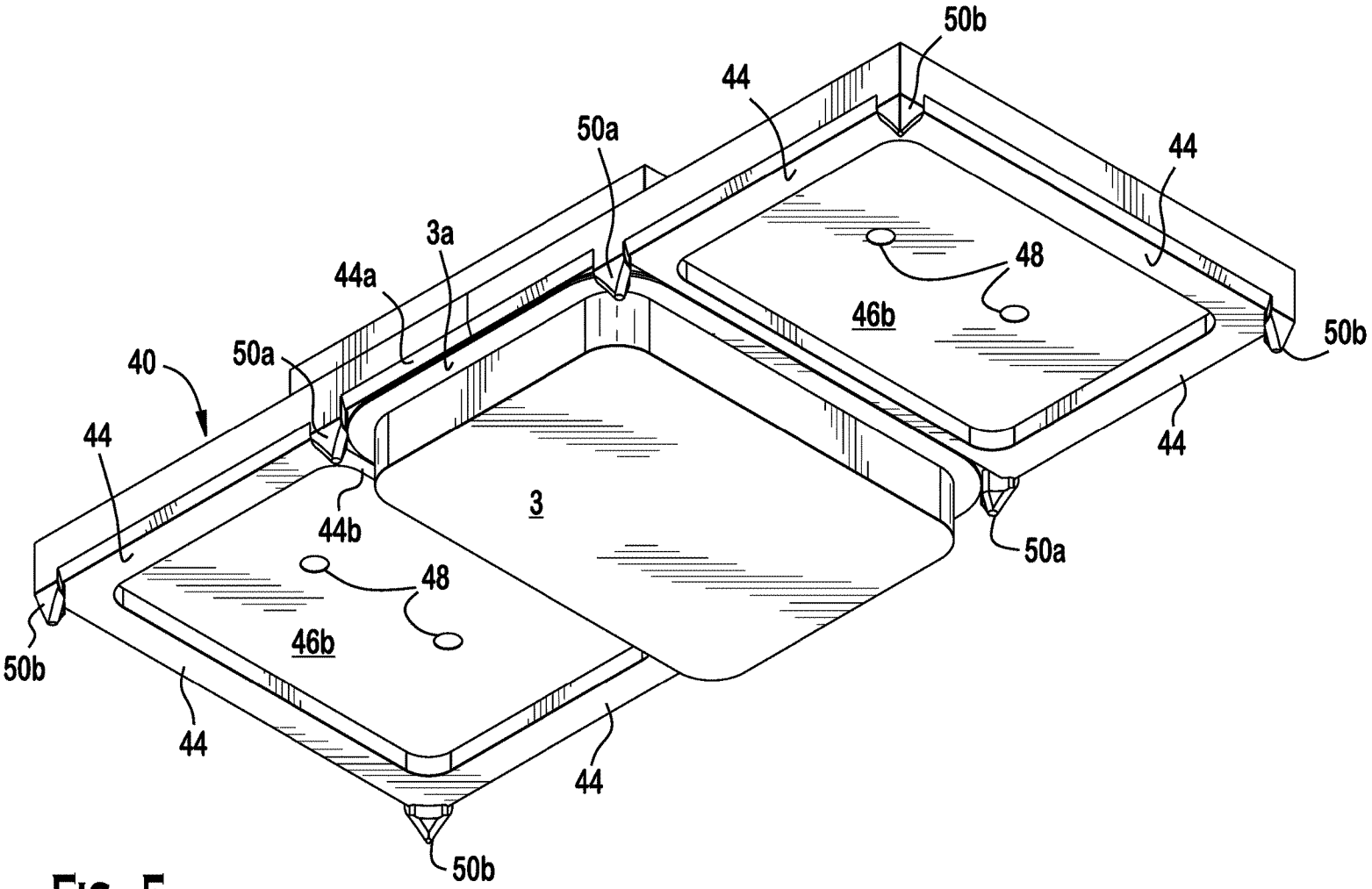
FIG. 5 is a front, bottom perspective view of a vacuum packaging apparatus according to the invention, showing a VSP product secured therewith.
Figure 6:
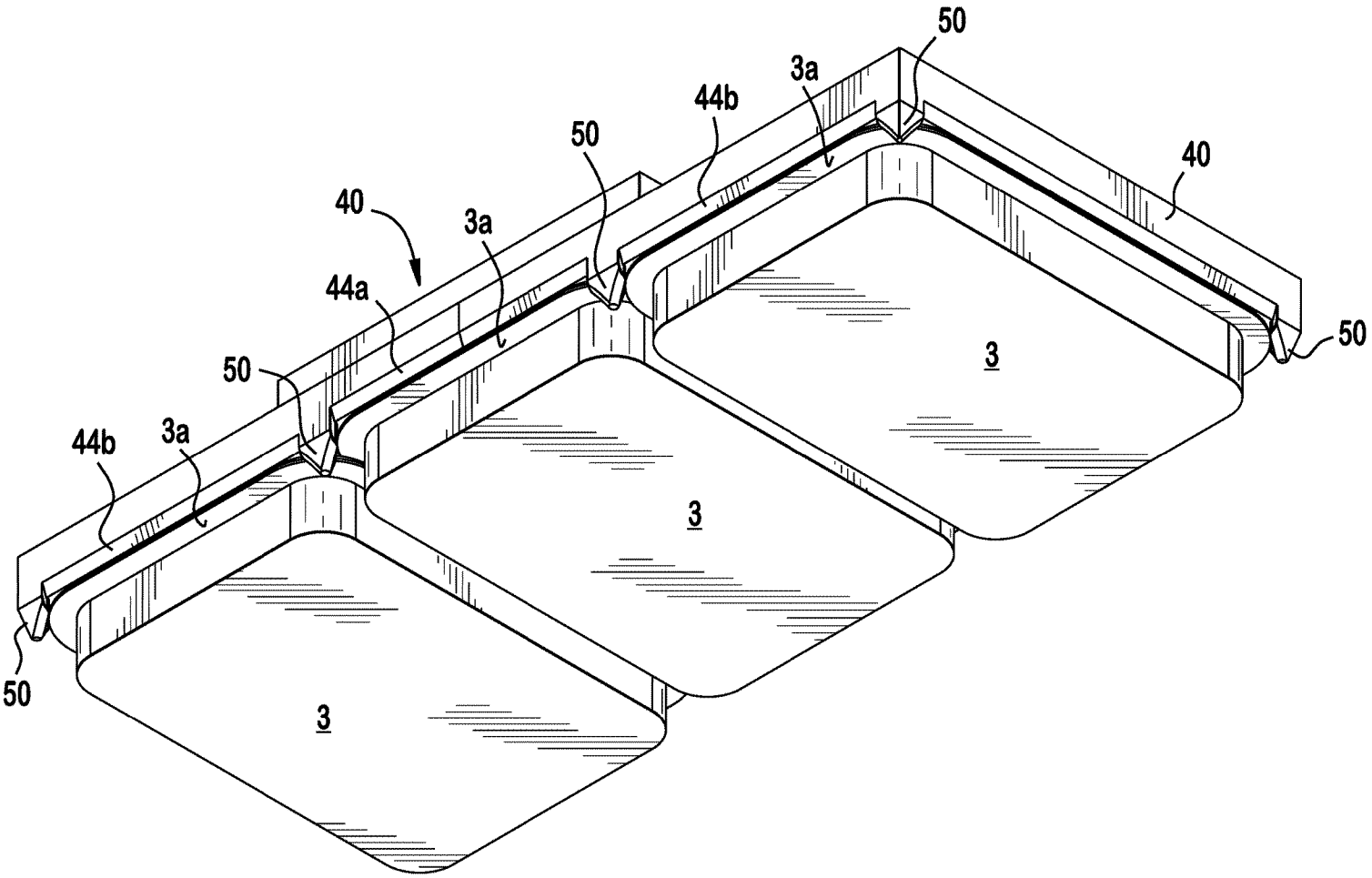
FIG. 6 is another front, bottom perspective view of a vacuum packaging apparatus according to the invention, again showing a plurality of VSP products secured to the bottom thereof in an overlapping manner with adjacent tray decks.
Figure 7:
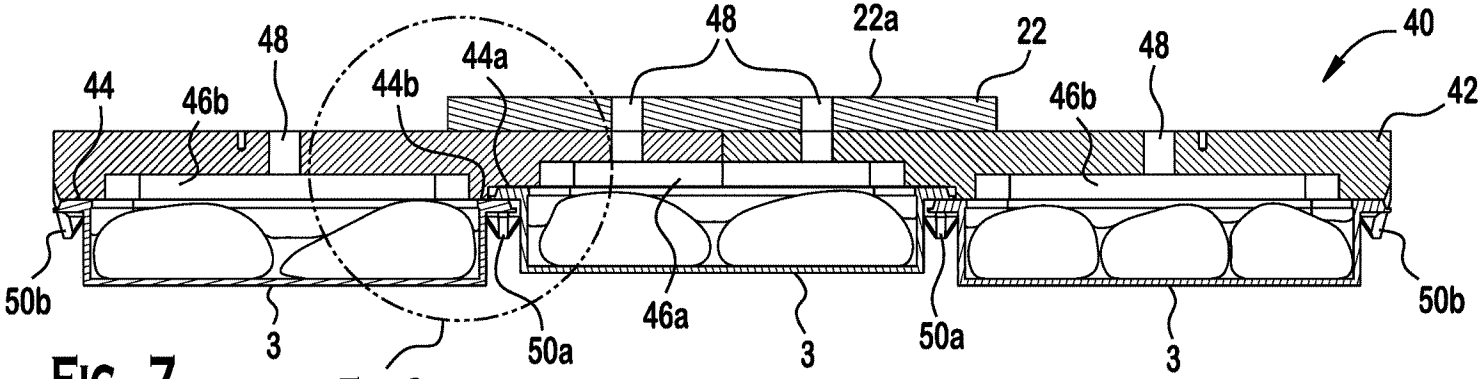
FIG. 7 is a sectional view of the vacuum packaging apparatus of FIG. 4, taken along line 7-7.
Figure 8:
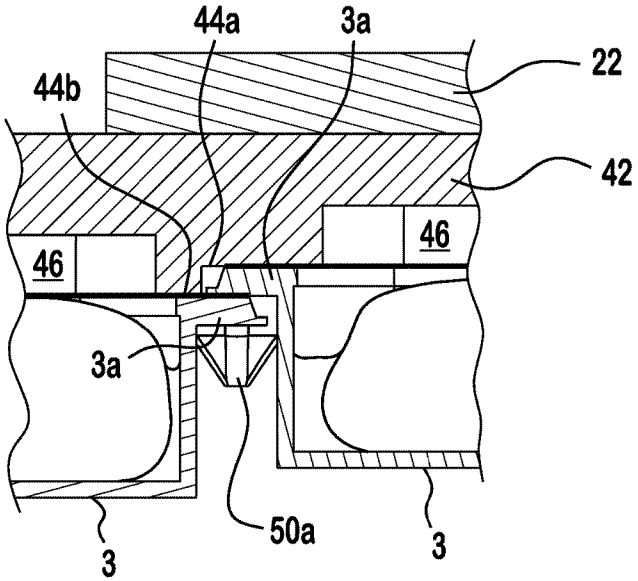
FIG. 8 is a sectional, close-up view vacuum packaging apparatus of FIG. 7, showing overlapping adjacent tray decks of the VSP products.
Figure 9:
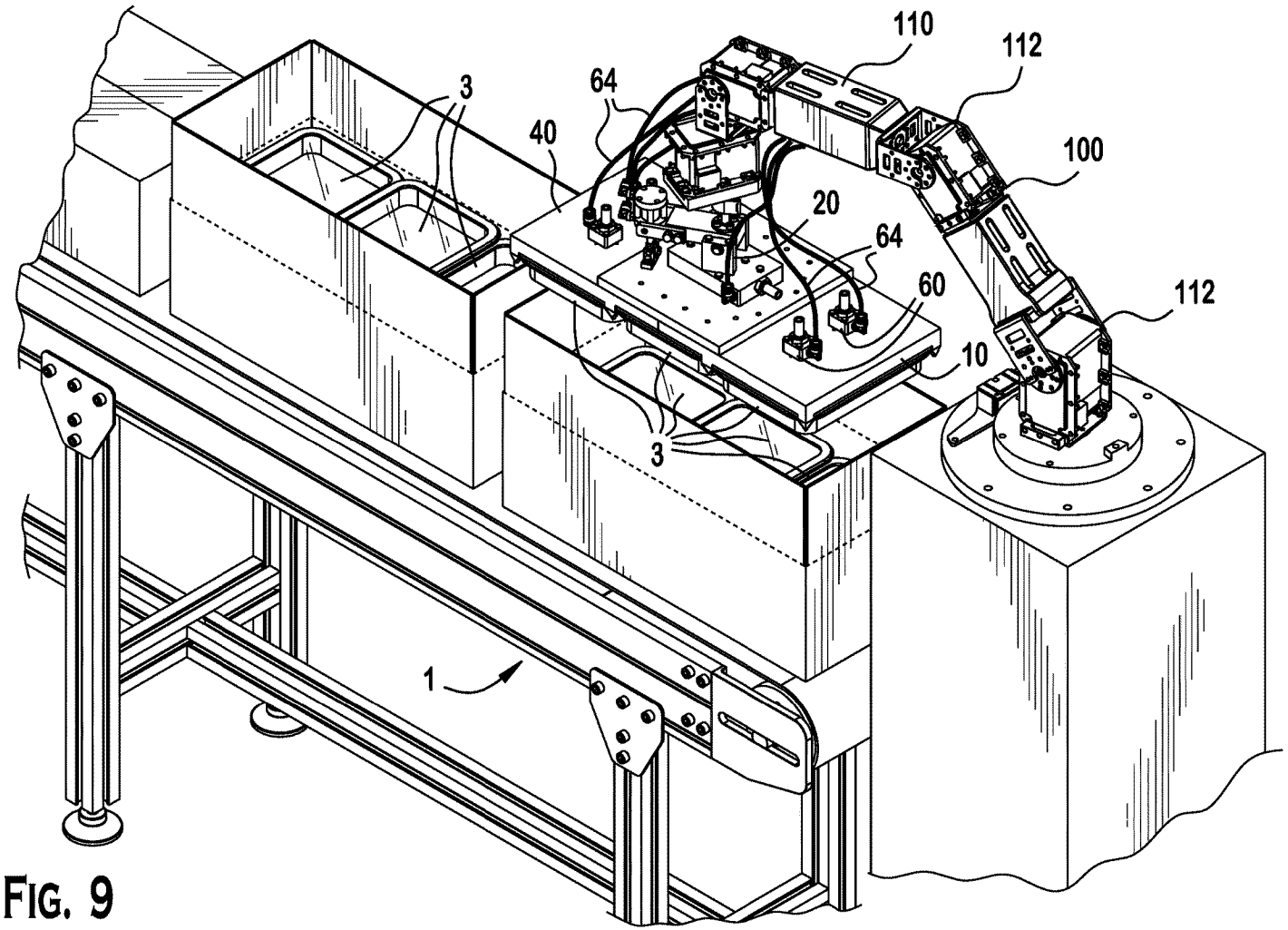
FIG. 9 is a perspective, front view of the robotic vacuum packing system of FIG. 1, showing use of the vacuum packing system according to the invention to transfer a plurality of known VSP products into a storage container.
Figure 10:
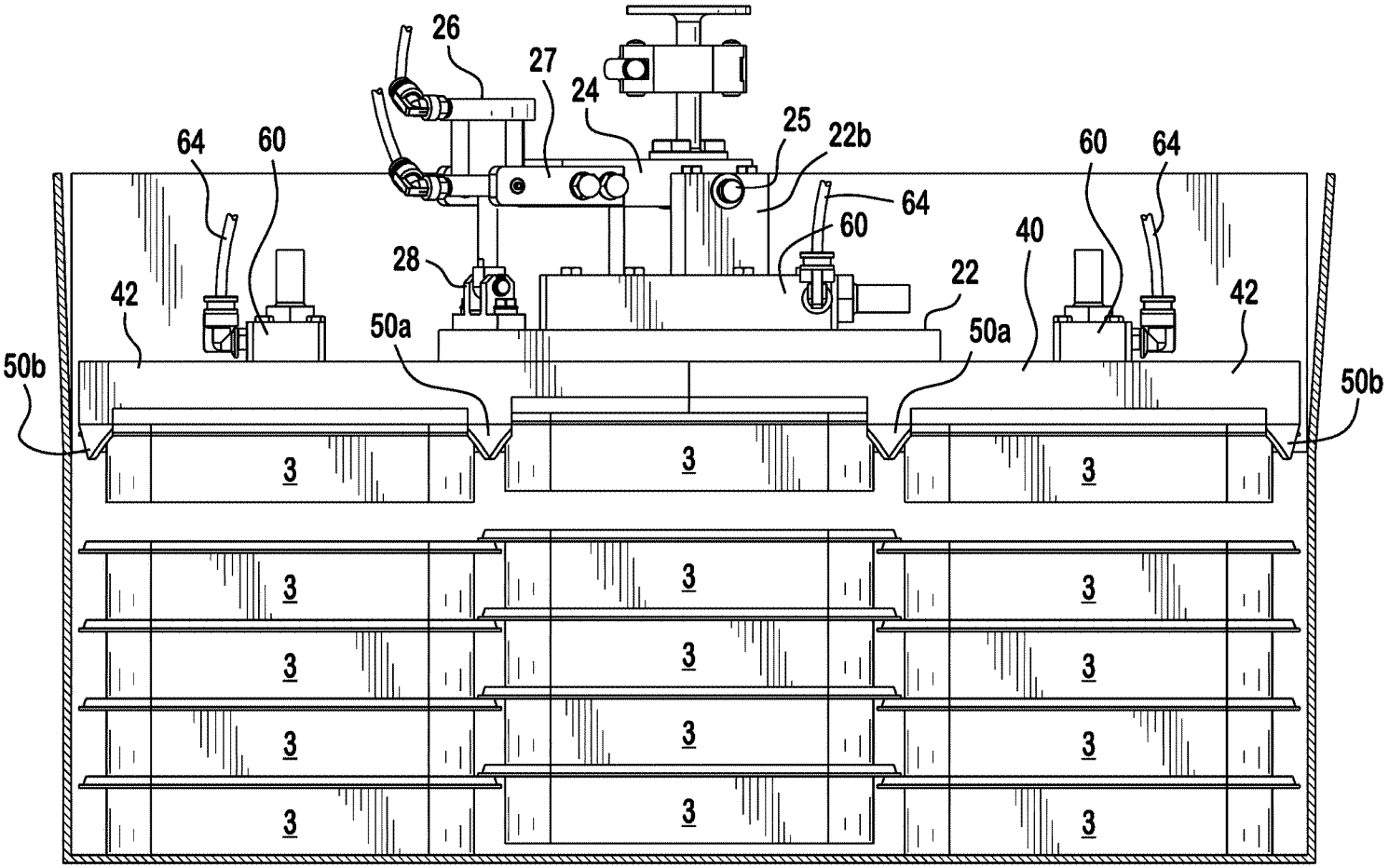
FIG. 10 is a front elevation view of a vacuum packing system according to the invention transferring known VSP products into a storage container.

With this configuration, a tray deck 3*a* of the VSP product 3 in the lower cavity 46*a* and the tray deck 3*a* of the VSP product 3 in either flanking upper cavities 46*b* overlap each other as shown in FIGS. 2, 4, 6, and particularly in FIGS. 7-8.

If only two cavities are provided, then one of the cavities is the lower cavity 46*a*, while the other is the flanking upper cavity 46*b*, and one of the cavity walls 44 is recessed from the other cavity wall 44. If four cavities are provided, the invention would include a pair of lower cavities 46*a* and a pair of flanking upper cavities 46*b* that are arranged in a repeating manner. The cavity walls 44 of the lower cavity 46*a* would be receded with respect to the cavity wall of the flanking upper cavity 46*b*. Although the positioning nodes 50 guide the VSP product 3 into the cavities 46, they also deter lateral movement of VSP product 3 when positioned above each of the cavities 46 *a, b*.

A plurality of vacuum channels 48 are provided and extend through the receiving plate 42 and into the cavities 46 *a,b*, as shown in FIGS. 3-5, and 7. The vacuum channels 48 are connected to the vacuum assembly 60 using lines 64. The vacuum channels 48 are positioned so as to enable the creation of a vacuum with the activation of the vacuum assembly 60.

Additionally, as shown in FIGS. 2-8, the receiving plate 42 of the pivot assembly 20 includes a plurality of positioning nodes 50 extending outward from the cavity walls 44. In the shown embodiment, each positioning node 50 is generally pyramidal-shaped protuberances in the embodiment shown and are positioned along a perimeter of the downward face of the receiving plate 42. As shown, the positioning nodes 50 are located to correspond with dimensions of the VSP product 3. For example, to assist in grasping VSP products 3, the positioning nodes 50 are located at the edges of the receiving plate 42. Since the positioning node 50 is a pyramidal-shaped protuberance, the VSP product 3 are toggled into position above a corresponding cavity wall 44.

As shown particularly in FIGS. 3-6, four positioning nodes 50 are positioned about each cavity 46 *a,b*. In the shown embodiment, four positioning nodes 50 are positioned about the lower cavity 46*a* (inner nodes 50*a*), while four more positioning nodes 50 are positioned at either end (outer nodes 50*b*) of the receiving plate 42. The outer nodes 50*b* serve to position a tray deck 3*a* along the upper cavity walls 44*b* of one upper cavity 46*b*, while the inner nodes 50*a* serve to position a tray deck 3*a* along the lower cavity walls 44*a* of one lower cavity 46*a* as well as another tray deck 3*a* along the upper cavity walls 44*b* of an adjacent upper cavity 46*b*.

The vacuum assembly 60 includes a pump source (not shown) and a plurality of vacuum generators, such as a vacuum on board system as sold by JLS Automation or a vacuum pump. As the pump source activates the vacuum generator, gas flows through the vacuum channels 48 to create a vacuum in the cavities 46 *a, b*. When the tray deck 3*a* of the VSP product 3 is fitted with the cavity walls 44, the receiving plate 42 grasps and lifts the VSP product 3 to transport the VSP product 3 a first location to a second location.

As shown in FIGS. 1 and 2, the articulating arm assembly 100 generally includes a robotic arm 110 and a stem 120. The robotic arm 110 is a known mechanical arm having a plurality of joints 112 and a power source (not shown; i.e. motors, hydraulics) to facilitate fluid movement of an end effector of the articulating arm assembly 100. In the present invention, the vacuum packaging apparatus 10 is the end effector of the articulating arm assembly 100. As shown, the stem 120 is an elongated member having a pair of flange surfaces 122 to connect the robotic arm 110 to the end effector and, in the present invention, the vacuum packaging apparatus 10. The length of the stem 120 may vary.

The robotic vacuum packing system 1 further uses an optical positioning system (not shown) to position the end effector with respect to spatial objects, including a plurality of VSP products 3 required to be moved and repositioned by the vacuum packaging apparatus 10.

The robotic vacuum packing system 1 using positioning technology to determine the position and orientation of a spatial object with respect to the vacuum packaging apparatus 10. In an embodiment of the invention, the optical positioning system (not shown) uses known cameras, beacons and/or sensors to identify position of VSP products 3 and then positions the vacuum packaging apparatus 10 with respect to the VSP products 3 to secure them therewith. In an exemplary embodiment, the optical positioning system (not shown) use machine vision to provide imaging-based automatic inspection and analysis for such applications as automatic inspection, process control, and robot guidance, The vacuum assembly 60 is connected to the articulating arm 2 with electronics and software known to one of skill in the art to control the timing and extent of a vacuum exerted on the VSP product 3 sufficient to securely grasp, lift, and move the plurality of VSP product from a first location to a second location.

Now with reference to the Figures, use of the vacuum packaging apparatus 10 according to an embodiment of the invention will be described. By way of example, the vacuum packaging apparatus 10 according to an embodiment of the invention is used with the robotic vacuum packing system 1 as described and positioning of the VSP product 3 to correspond with the cavities 46.

As shown, the articulating arm 2 is connected to vacuum packaging apparatus 10 and the positioning assembly 40 that provides information to the robotic arm 110 for positioning of the vacuum packaging apparatus 10. FIG. 1 illustrates VSP products 3 approaching the vacuum packaging apparatus 10 on a conveyer belt from the right in advance of the operation of the vacuum packaging apparatus 10.

The vacuum packaging apparatus 10 is directed into position with the positioning assembly 40, and grasps the upward-facing surface of a plurality of VSP products 3 with the vacuum assembly 60 in two stages. First, positioning assembly is positioned above a VSP product 3. More particularly, the receiving plate 42 is positioned such that the lower cavity 46*a* is positioned to grasp a VSP product 3. As the articulating arm assembly 100 lowers the receiving plate 42 above the VSP product 3, the inner nodes 50*a* position the tray deck 3*a* along the lower cavity walls 44*a*. The vacuum assembly 60 activates and the tray deck 3*a* is held about the lower cavity walls 44*a* corresponding with the lower cavity 46.

Next, the articulating arm assembly 100 positions the receiving plate 42 above another VSP product 3 to correspond with one of the upper cavities 46*b* on either side of lower cavity 46*a*. When activated, the vacuum assembly 60 then secures the tray deck 3*a* of this VSP products 3 with the upper cavity walls 44*b* and thus overlaps the tray decks 3*a* of the VSP product 3 in the lower cavity 46*a*. This two-stage assembly sequence creates a more secure vacuum grasp of the plurality of VSP product 3 in the pivot assembly 20.

The robotic arm assembly 100 then moves the receiving plate 42 with one or more VSP products 3 attached thereto. When it is determined that the receiving plate 42 is positioned above a shipping container, such as a corrugated box, the pivot mechanism 26 activates and the lever 24 pivots, tilting the positioning assembly 40 so the VSP product 3 can be jogged into the box.

The pivot assembly 20 and positioning assembly 40 may be constructed of various materials chosen by those of ordinary skill in the art. The materials chosen reflect the conditions under which they will be operated, including an ability to be secured to the indicated tools and to each other, and to have other properties useful in the repetitive operation of the apparatus and system. Typically, the materials chosen for these features are polymeric or metal.

As referred to herein, the lines 64 connecting the air supply (not shown) to the cavities 46 are flexible and capable of maintaining the required vacuum. Typically, the materials chosen for these features are polymeric, of natural materials such as rubber, and the like.

Also, the indefinite articles "a" and "an" preceding an element or component of the invention are intended to be nonrestrictive regarding the number of instances, that is, occurrences of the element or component. Therefore "a" or "an" should be read to include one or at least one, and the singular word form of the element or component also includes the plural unless the number is obviously meant to be singular.

The term "invention" or "present invention" as used herein is a non-limiting term and is not intended to refer to any single embodiment of the particular invention but encompasses all possible embodiments as described in the application.

The terms "a product" and "the product" are used in the present text in the singular form only for the sake of conciseness, but should be read as actually encompassing either one or more products. In particular, the claimed process encompasses not only the transfer or relocation of a single package that may contain one or a plurality of packages, each one containing one or a plurality of products, but also the transfer or relocation of a plurality of packages, each one containing one or a plurality of products.

The foregoing illustrates some of the possibilities for practicing the invention. Many other embodiments are possible within the scope and spirit of the invention. The disclosed invention utilizes the above identified components, as a system, in order to more efficiently construct a vacuum packaging apparatus for a particular purpose. Therefore, more or less of the aforementioned components can be used to conform to that particular purpose. It is, therefore, intended that the foregoing description be regarded as illustrative rather than limiting, and that the scope of the invention is given by the appended claims together with their full range of equivalents.

What is claimed is:

1. A vacuum packaging apparatus for securing a plurality of vacuum skin packaging (VSP) products comprising:

a receiving plate having a planar bottom surface;

a plurality of cavity walls extending downward from the planar bottom surface and providing a plurality of cavities there within, the plurality of cavity walls having:

an upper cavity wall encircling an upper cavity of the plurality of cavities, and a lower cavity wall encircling a lower cavity adjacent to the upper cavity and recessed with respect to the upper cavity walls;

a plurality of vacuum channels extend through the receiving plate and into the plurality of cavities.

2. The vacuum packaging apparatus of claim 1, wherein the plurality of cavity walls have upper planar surfaces that runs parallel along a common plane.

3. The vacuum packaging apparatus of claim 2, wherein a height difference between the lower cavity wall and the upper cavity wall is about the a thickness of a tray deck of a VSP product of the plurality of VSP products.

4. The vacuum packaging apparatus of claim 3, wherein outer sections of the upper cavity wall is the same as a width of the lower cavity wall.

5. The vacuum packaging apparatus of claim 4, wherein inner sections of the upper cavity wall are smaller thinner than the width of the outer sections of upper cavity wall and the width of the lower cavity wall.

6. The vacuum packaging apparatus of claim 2, further comprising a plurality of positioning nodes positioned about each cavity of the plurality of cavities.

7. The vacuum packaging apparatus of claim 6, wherein the plurality of positioning nodes include inner nodes extending from the lower cavity wall and are positioned about corners defining the lower cavity.

8. The vacuum packaging apparatus of claim 7, wherein the plurality of positioning nodes include upper nodes extending from the upper cavity wall and are positioned about corners defining the upper cavity.

9. The vacuum packaging apparatus of claim 8, wherein the inner nodes are pyramidal-shaped protuberances that are angled toward the lower cavity.

10. The vacuum packaging apparatus of claim 9, wherein the upper nodes are pyramidal-shaped protuberances that are angled toward the upper cavity.

11. The vacuum packaging apparatus of claim 2, further comprising a second upper cavity wall encircling a second upper cavity of the plurality of cavities that is positioned along another adjacent side of the lower cavity wall.

12. The vacuum packaging apparatus of claim 11, wherein the plurality of positioning nodes include upper nodes extending from the upper cavity wall and are positioned about corners defining the upper cavity.

13. The vacuum packaging apparatus of claim 1, further comprising a plurality of vacuum generators connected to the plurality of vacuum channels and providing suction with the plurality of cavities.

14. The vacuum packaging apparatus of claim 13, wherein the plurality of vacuum generators include a vacuum pump.

15. The vacuum packaging apparatus of claim 14, further comprising a pivot assembly having a mounting plate secured to the receiving plate, a lever rotatably connected to the mounting plate, and a pivot mechanism pivotable with respect to the lever and the receiving plate.

16. The vacuum packaging apparatus of claim 15, wherein the mounting plate includes a body secured to the receiving plate and a pair of vertical supports extending upward from and positioned perpendicular with respect to a planar surface of the body.

17. The vacuum packaging apparatus of claim 15, wherein the lever is an elongated member that is pivotally secured to the vertical supports by a support pin that runs through the lever.

18. The vacuum packaging apparatus of claim 17, wherein the lever pivots about the support pin with respect to a position of the receiving plate.

19. The vacuum packaging apparatus of claim 18, wherein the pivot mechanism is a switch that activates on and off based on a pivot position of the lever with respect to the receiving plate.

* * * * *